United States Patent [19]

Delano

[11] 3,951,208

[45] Apr. 20, 1976

[54] TECHNIQUE FOR CEMENTING WELL BORE CASING

[76] Inventor: Charles G. Delano, 430 Sharon, Corpus Christi, Tex. 78412

[22] Filed: Mar. 19, 1975

[21] Appl. No.: 559,887

[52] U.S. Cl. ..... 166/78; 166/285

[51] Int. Cl.[2] ..... E21B 33/03

[58] Field of Search ..... 166/285, 70, 78, 75; 175/195, 122

[56] References Cited

UNITED STATES PATENTS

| | | | |
|---|---|---|---|
| 2,609,881 | 9/1952 | Warren | 166/285 |
| 2,675,082 | 4/1954 | Hall | 166/285 |
| 3,507,325 | 4/1970 | Scott | 166/70 X |
| 3,616,850 | 11/1971 | Scott | 166/70 X |
| 3,777,819 | 12/1973 | Delano | 166/285 |
| 3,828,852 | 8/1974 | Delano | 166/70 X |

*Primary Examiner*—John E. Murtagh
*Assistant Examiner*—Richard E. Favreau
*Attorney, Agent, or Firm*—G. Turner Moller

[57] ABSTRACT

There is disclosed an apparatus capable of simultaneous or sequential rotation and reciprocation of a casing string during the process of cementing the same in a well bore. There is provided a device for launching sealing elements such as spheres, go-devils or cementing plugs into the casing string. This device is mounted on a stationary part of a swivel and does not rotate during rotation of the casing string.

5 Claims, 3 Drawing Figures

TECHNIQUE FOR CEMENTING WELL BORE CASING

This invention comprises an improvement over the techniques disclosed in U.S. Pat. Nos. 3,777,819 and 3,828,152 to which reference is made for background information. Of more general interest is an article in The Oil Weekly, Dec. 4, 1939, pages 14 and 15, entitled "Rotating While Cementing Proves Economical."

The apparatus disclosed in the aforementioned patents comprises, from the top down, a lift nipple for connection to casing elevators carried by the traveling block of a drilling rig, a swivel having a stationary portion connected to the lift nipple and a rotatable portion, a power unit having a conduit connected to a rotatable swivel portion for rotating the conduit, and a cementing sub or head which carries one or more sealing elements, such as cementing plugs, which are launched into the casing string being cemented in accordance with conventional cementing techniques. The cementing sub basically comprises a container for the sealing elements, a retainer mechanically blocking the sealing elements from movement out of the container, means for bypassing mud around the sealing elements and a reusable mechanism for manipulating the retainer to a non-blocking position releasing the sealing elements for travel into the casing string. Below the cementing head is an adapter which connects the threads of the cementing head to the threads provided by the casing string being cemented. It is accordingly apparent that the cementing head is in torque transmitting relation between the power unit and the tubular string being cemented. Accordingly, when the tubular string is being rotated, the cementing head is rotating. In order to manipulate the valves and retainers on the cementing head to launch the sealing elements, rotation of the tubular string must be stopped. This has undesirable aspects since anytime pipe is in the hole and not moving, there is a danger of the pipe sticking when movement is again commenced. It is therefore desirable to have the capability of launching sealing elements while rotating the casing string.

By this invention, sealing elements may be launched into the casing string while the casing string is being rotated.

In summary, this invention comprises apparatus for cementing a tubular string in a well bore including swivel means having a stationary portion providing a fluid passage having an inlet thereto and means for attaching the swivel means to hoist means, and a rotatable portion including a fluid outlet in communication with the fluid passage; a power unit having a conduit in communication with the fluid outlet, a torque applier for applying torque to the conduit and thereby rotating the same, means for controlling the torque output of the torque applier, and means for connecting the conduit to the tubular string; and a sealing element launcher comprising a sealing element container in communication with the stationary fluid passage and means for launching at least one sealing element into the stationary fluid passage. IN THE DRAWINGS:

Figure 1:
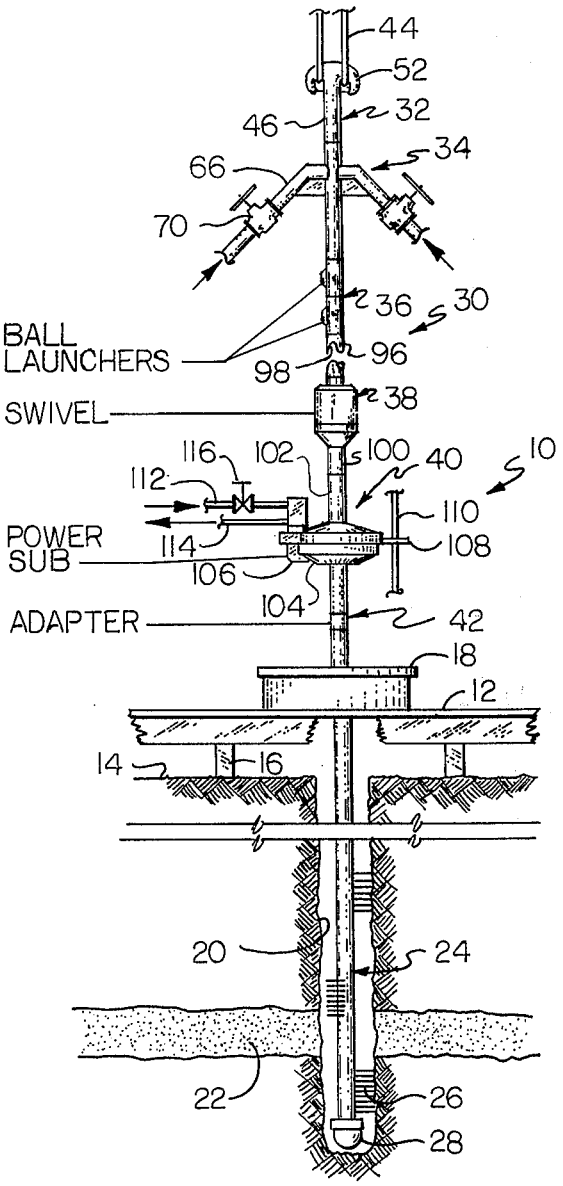
FIG. 1 is a cross-sectional view of a portion of a bore hole and drilling rig illustrating the apparatus of this invention.

Referring to FIG. 1, there is illustrated a drilling rig 10 comprising a floor 12 elevated above a ground surface 14 by a substructure 16. The drilling rig 10 includes a rotary table 18, a derrick (not shown), a drawworks (not shown) and other typical equipment. A borehole 20 is illustrated as extending into the earth and penetrating a formation 22. A tubular string 24 is illustrated as extending into the borehole 20 and is comprised of a plurality of threadably connected joints of pipe of any desired size. In a conventional manner, the tubular string 24 carries a plurality of scratchers 26, a cementing shoe 28 and other cementing equipment such as centralizers, float equipment and the like, as may be desired during the cementing of the string 24 in the borehole 20.

In order to either simultaneously or sequentially reciprocate and rotate the string 24, there is provided equipment 30 comprising as major components a lift device 32, a fluid inlet sub 34, a cementing sub 36, a swivel 38, a rotating tool 40 and an adapter 42 for connecting the threads of the uppermost pipe joint to the rotating tool 40. As will be more fully apparent hereinafter, the equipment 30 may be manipulated to either simultaneously or sequentially rotate and reciprocate the string 24 by energizing the rotating tool 40 in conjunction with raising and lowering of the lift device 32 by a pair of bails 44 carried on the traveling block (not shown) of the drilling rig 10.

Figure 2:
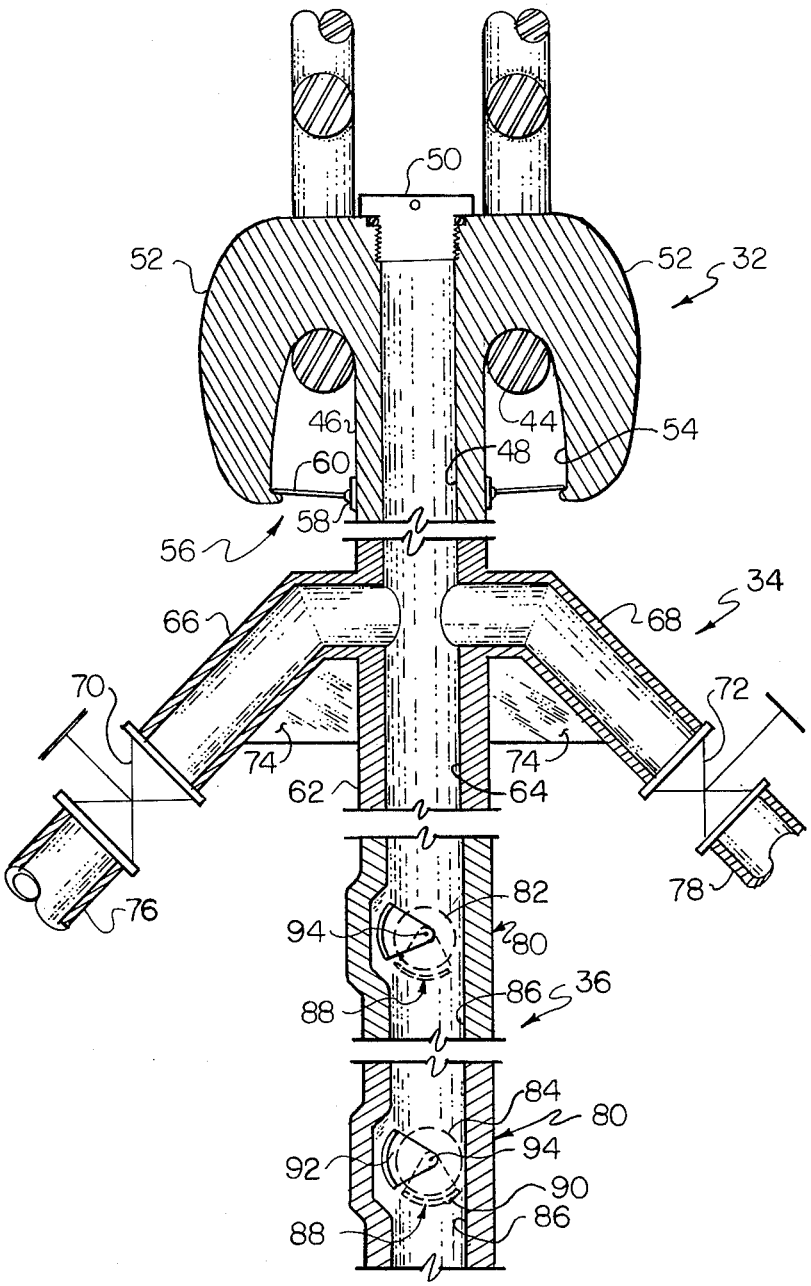
FIG. 2 is a cross-sectional view of the upper end portion of the cementing tool illustrated in FIG. 1.

Referring to FIG. 2, the lift device 32 is illustrated as comprising a central conduit 46 having a passage 48 closed by a screw connection 50 and a pair of ears 52 extending on opposite sides of the conduit 46 and providing a pair of re-entrant slots 54. The bails 44 are conveniently of conventional design providing an eye at the lower end thereof which may be passed into the slot 54 beyond a spring biased latch 56. The latches 56 act to retain the bails 44 in the slots 54 when no weight is carried by the bails 44. The latches 56 comprise a hinge 58 affixed to the conduit 46, a gate 60 of sufficient length to span the entrance to the slot 54 and a spring (not shown) integral with the hinge 58 for biasing the gate 60 downwardly.

The lift device 32 is conveniently threaded into the top of a conduit 62 provided by the fluid inlet sub 34. The conduit 62 provides a central passage 64 communicating with the passage 48. A pair of fluid inlet conduits 66, 68 open into the passage 64 and are controlled by suitable valves 70, 72. Suitable reinforcing members such as gussets 74 rigidify the conduits 62, 66, 68. Stub conduits 76, 78 extend from the valves 70, 72 respectively and are provided with suitable unions (not shown) for connection to the rig mud line and to the cement line provided by the cementing company.

Threaded into the bottom of the conduit 62 is the cementing sub 36 which may be of any desired type but which is illustrated as comprising a pair of threadably connected devices 80 for launching a pair of sealing elements 82, 84 into the string 24 during cementing. The launching devices 80 each comprise a central passage 86 providing a compartment for the sealing elements 82, 84 and a retainer 88 for precluding movement of the elements 82, 84 through the passage 86. In the illustration of FIG. 2 where the sealing elements 82, 84 comprise spheres, the retainers 88 conveniently comprise an arcuate sheet metal section 90 journaled by a pair of arms 92 for rotation about an axis 94. A suitable axle (not shown) extends through the wall of the device 80 and is configured to receive a suitable wrench for moving the retainers 88 between the positions illustrated in FIG. 2.

The swivel unit 38 may be generally as illustrated and described in the aforementioned patents to which reference is made for a more complete description thereof. It will suffice to say that the swivel unit 38 may be of any desired type comprising a stationary portion 96 having a fluid passage 98 therethrough, a rotatable portion 100 including a fluid outlet end in communication with the fluid passage 98 and suitable bearings (not shown) to accommodate relative rotation between the portions 96, 100 at anticipated loads.

The rotating tool 40 may be of any desired type so long as it has operating characteristics commensurate with its desired functions. As will be more fully apparent hereinafter, the rotating tool 40 transmits liquids or slurries pumped into the fluid inlet sub 34 toward the casing string 24, allows reciprocation of the equipment 30 through a substantial stroke and rotates the string 24 at desired torque and speed levels. One particular device that has proved satisfactory is a power sub manufactured by Bowen Tools, Inc., Houston, Tex., and described in an instruction manual printed in December 1965, to which reference is made for a more complete description thereof.

The rotating tool 40 comprises a conduit 102 threadably attached at the upper end thereof to the rotatable swivel portion 100 and threadably attached at the lower end thereof to the adapter 42. A housing 104 encloses a gear wheel operatively connected to the conduit 102 and driven by a hydraulic motor 106. The housing 104 includes a bracket 108 apertured to receive a stationary guide 110 therethrough. It will accordingly be seen that the rotating tool 40 is constrained for vertical movement by the guide 110 which acts to assure that the conduit 102 is rotated rather than the housing 104. The motor 106 is provided with suitable hydraulic lines 112, 114 for delivering and returning power fluid from the motor 106 to a suitable pump (not shown). Suitable controls such as a valve 116 and pressure gauges are provided as desired in order to limit the amount of torque applied by the power sub 40 to the casing string 24 to a valve less than the joint strength of the couplings constituting the string 24.

The adapter 42 may be of any suitable type and is preferably a pup joint having threads at one end thereof to match the threads in the casing string 24 and having threads at the other end thereof to match the threads on the conduit 102.

Assuming for purposes of illustration that the casing string 24 is of relatively small diameter, e.g. nominal 2⅞ inch O.D., the sealing elements 82, 84 may comprise hard rubber spheres of slightly greater diameter than the internal diameter of the casing string 24. In the alternative, conventional generally cylindrical cementing plugs may be employed with the launchers 80 comprising conventional cementing subs.

It will be apparent that the equipment 30 provides an attachment to the hoist means of the drilling rig 10, provides for the selective injection of drilling mud and cement slurry into the well bore 20 and allows rotation of the string 24. Since the cementing sub 36 is attached to the stationary portion of the swivel unit 38, the sealing element launchers 80 do not rotate.

In operation, the tubular string 24 is run through the rotary table 18 into the well bore 20 in a conventional manner. After the last joint comprising the string 24 is run into the well bore 20, the casing slips or set into the rotary table 18 and the casing elevators (not shown) removed from the top joint. The adaptor 42 is threadably attached to the exposed collar of the casing string. The casing elevators are removed from the bales 44 which are then attached to the lift device 32 which has been preassembled with the cementing sub 36, the swivel unit 38 and the power unit 40. These components are then hoisted and moved to threadably engage the lower end of the conduit 102 into the top of the adaptor 42. The mud and cement lines are then attached to the stub conduits 76, 78 and the hydraulic lines 112, 114 connected. The equipment 30 is accordingly ready to commence simultaneous or sequential rotation and reciprocation of the casing string 24.

To reciprocate the string 24, the driller manipulates the draw works in a conventional manner to raise the elevators 38 and thereby raise the string 24. Power hydraulic fluid is delivered through the line 112 to drive the motor 106 and thereby rotate the string 24. After a desired stroke is achieved, the driller manipulates the drawworks in a conventional manner to allow the string 24 and the equipment 30 to fall in a controlled fashion into the well bore 20. The rate of descent of the equipment 30 is controlled by the drawworks brake in a conventional manner. Rotating and reciprocating the string 24 in this fashion causes the scratchers 26 to abrade the wall of the bore hole 20 and thereby remove cuttings embedded in the bore hole wall, excess filter cake and the like. During initial rotation and reciprocation, clean drilling fluid is pumped into the inlet sub 34, down the equipment 30, down the string 24, through the cementing shoe 28 and upwardly through the annulus to the mud pits in a conventional manner.

After the bore hole 20 has been scratched and circulated for some time, a decision is made that the bore hole 20 has been conditioned sufficiently for cementing. Since the sealing element launchers 80 are connected to the stationary portion of the swivel unit 38, it is apparent that they can easily be manipulated, either by a workman in the derrick or by suitable remote controls (not shown). In any event, the mud valve is closed and the retainer 88 of the lowermost launcher 80 is moved to the solid line position of FIG. 2 for releasing the sealing element 84 contemporaneously with pumping cement slurry into the fluid inlet sub 34. When the desired quantity of cementing slurry has been introduced into the casing string 24, the upper launcher 80 is manipulated for launching the sealing element 82. If the launchers 80 are manipulated manually by a workman in the derrick, reciprocation of the string 24 must cease in order to provide access to the launchers 80. If the launchers 80 are manipulated by a remote control mechanism, it will be apparent that reciprocation of the string 24 need not cease. Rotation and/or reciprocation of the string 24 is again commenced and drilling mud is pumped into the fluid inlet sub 34.

When the first sealing element 84 comes to rest in the cementing shoe 28, larger ports are normally opened therein and cementing slurry passes into the annulus defined between the well bore 20 and the casing string 24. Pumping of drilling mud through the inlet sub 24 continues until the second sealing element 82 contacts the cementing shoe 28. Flow through the cementing shoe 28 is thereupon halted and upward travel of the cementing slurry through the annulus ceases. Rotation and/or reciprocation of the string 24 continues and results in substantially uniformed dispersion of the cementing slurry throughout the bottom part of the annulus.

In the embodiment heretofore described, it will be apparent that the clear internal diameter through the equipment 30 must be no less than the internal diameter of the casing string 24. When designing the equipment 30, it is no real difficulty to provide a 2-4 inch clearance through the equipment 30 but altogether a different proposition to provide a 9–12 inch clear internal diameter that would be required to cement the largest size casing customarily used in the industry. It is accordingly anticipated that the spherical sealing elements 82, 84 shall be used to seal against relatively small size pipe.

Figure 3:
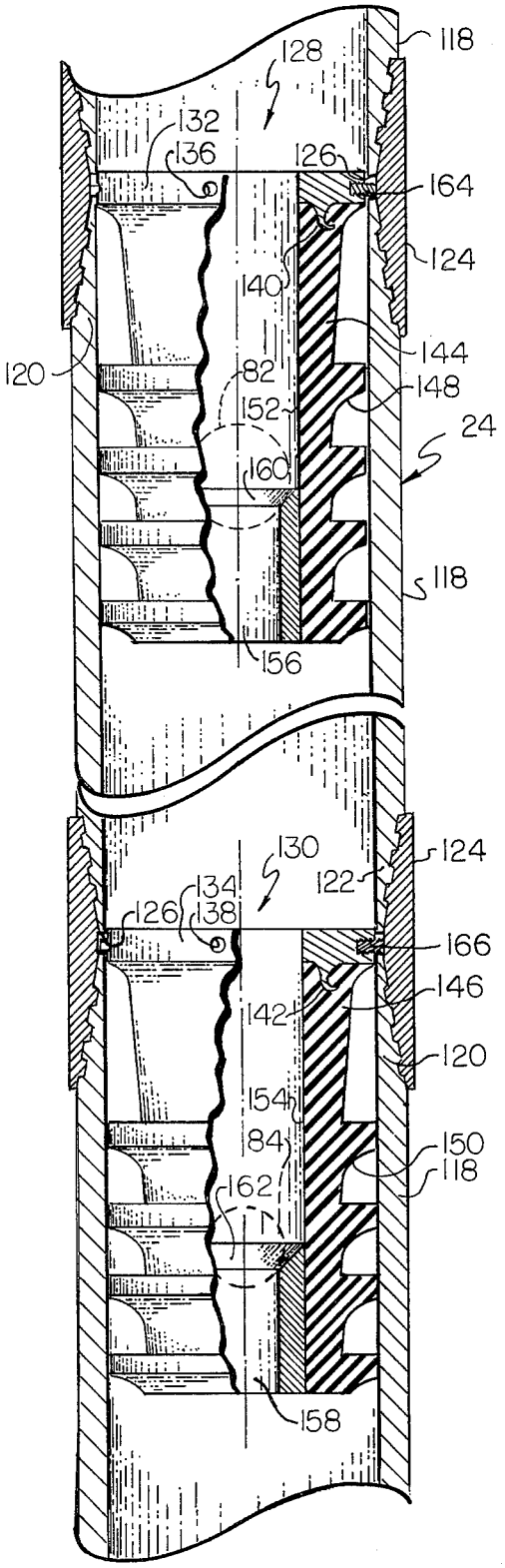
FIG. 3 is an enlarged cross-sectional view of a section of the casing string having wiper plugs therein.

Referring to FIG. 3, there is illustrated a convenient technique for utilizing the equipment 30 having a relatively small clear internal diameter therethrough to cement casing having a much larger internal diameter. The casing string 24 is illustrated as comprising a plurality of joints 118 provided with upper and lower male threaded ends 120, 122 and a collar 124 connecting adjacent joints 118 together. Typical oil field tubular goods provide a gap 126 inside each collar 124.

Disposed in the casing string 24 is an upper wiper plug 128 and a lower wiper plug 130 which bear many similarities. The plugs 128, 130 each comprise an annular collar 132, 134, which is preferably of aluminum, bronze or other soft metal, having a plurality of radially extending threaded openings 136, 138 and a circumferentially extending member 140, 142 providing an anchor for a molded resilent body 144, 146. Extending about the periphery of the bodies 144, 146 are a plurality of wiper rings 148, 150. The wiper plugs 130, 132 further comprise a gently tapered central passage 152, 154 in the bottom of which is a metallic sleeve insert 156, 158 providing a sealing lip or bevel 160, 162 thereon.

It will be apparent that the major difference between the wiper plugs 128, 130 reside in the comparative sizes of the openings in the sleeve inserts 156, 158. The passage through the insert 156 is somewhat larger than the passage through the insert 158 in order to pass a spherical sealing element therethrough which will sealably engage the bevel 162. Accordingly, the clear internal dimension of the upper wiper plug 128 exceeds the minimum diameter of the sealing lip 162. Accordingly, the sealing element 84 may be passed through the upper wiper plug 128 to engage the sealing lip 162. Since the upper passage 152 and sealing lip 160 are substantially larger, the upper sealing element 82 is preferably substantially larger than the lower sealing element 84.

The second major difference between the wiper plugs 128, 130 resides in the configuration of the metallic sleeve inserts 158, 160. It is desirable, in the first launched or lower wiper plug 130 to provide means for passing cement therethrough when the wiper plug 130 contacts the cementing shoe 28. This may conveniently be accomplished by making the sleeve 158 of substantial thickness and press fitting the same in the tapered passage 154. When the lower cementing plug 130 engages the cementing shoe 28, pump pressure builds up inside the string 24 and in effect extrudes the sealing element 84 and sleeve 158 out of the passage 154. This feature is undesirable in the second cementing plug 128 so the sleeve 156 is conveniently glued to the body 144.

In order to place the plugs 128, 130 in the casing string 24, it is necessary merely to thread a plurality of shear screws 164, 166 in the respective openings 136, 138 and place the plugs 128, 130 in an open collar adjacent the rotary table 18 as this particular joint is being made up. It will be apparent that when the next joint is threaded into the collar 124, the shear screws 164, 166 are captivated. It will be apparent that the wiper plugs 128, 130 may be disposed at any desired location in the string 24 or adaptor 42. Although the wiper plugs 128, 130 are of somewhat unusual design, it will be apparent that conventional liner wiper plugs, such as those offered by Brown Oil Tools, Houston, Texas, along with conventional means for temporarily positioning the wiper plugs in the casing string 24 may be emphasized.

In order to reload the launchers 80, it is necessary only to remove the screw cap 50, manipulate the retainers 88 to desired positions and drop new sealing elements into the passage 48.

I claim

1. Apparatus for cementing a tubular string in a well bore comprising swivel means having a stationary portion providing a fluid passage having an inlet thereto and means for attaching the swivel means to hoist means, and a rotatable portion including a fluid outlet in communication with the fluid passage;

a power unit having a conduit in communication with the fluid outlet, a torque applier for applying torque to the conduit and thereby rotating the same, means for controlling the torque output of the torque applier, and means for connecting the conduit to the tubular string; and a sealing element launcher comprising a sealing element container in communication with the stationary fluid passage and means for launching at least one sealing element from the container into the stationary fluid passage.

2. The apparatus of claim 1 wherein the sealing element launcher and the power unit conduit are out of torque transmitting relation.

3. The apparatus of claim 2 further comprising the tubular string and wherein the internal dimensions of the fluid passage, fluid outlet and power unit conduit are at least as large as the internal dimension of the tubular string.

4. The apparatus of claim 2 wherein the sealing element container is carried by the stationary swivel portion and the sealing element launcher further comprises means for retaining a sealing element in the container and means for releasing the sealing element for travel into the stationary fluid passage.

5. The apparatus of claim 4 further comprising the tubular string having a passage therethrough and a wiper plug having a periphery for wiping the internal dimension of the tubular string passage and a central passage for receiving a sealing element for closing the central passage; and wherein the internal dimension of the stationary portion fluid passage and fluid outlet and the power unit conduit is smaller than the internal dimension of the tubular string passage.

* * * * *